United States Patent [19]

Yoshizawa

[11] Patent Number: 4,732,833

[45] Date of Patent: Mar. 22, 1988

[54] ELECTROPHOTOGRAPHIC PHOTORECEPTOR COMPRISING AMORPHOUS SILICON AND PARA MICROCRYSTALLINE SILICON

[75] Inventor: Shuji Yoshizawa, Tokyo, Japan

[73] Assignee: Kabushiki Kaisha Toshiba, Kawasaki, Japan

[21] Appl. No.: 9,296

[22] Filed: Jan. 30, 1987

[30] Foreign Application Priority Data

Mar. 26, 1986 [JP] Japan ..... 61-67928

[51] Int. Cl.[4] ..... G03G 5/08

[52] U.S. Cl. ..... 430/84; 430/65

[58] Field of Search ..... 430/84, 65

[56] References Cited

U.S. PATENT DOCUMENTS 4,560,634 12/1985 Matsuo ..... 430/66 X

FOREIGN PATENT DOCUMENTS 59-12448 1/1984 Japan .

OTHER PUBLICATIONS

J. Shirafuji et al., "Effect of Substrate Temperature on Properties of Glow-Discharged Hydrogenated Amorphous Silicon", Japanese Journal of Applied Physics, vol. 23, No. 10, Oct. 1984, pp. 1278-1286.

*Primary Examiner*—J. David Welsh

*Attorney, Agent, or Firm*—Schwartz, Jeffery, Schwaab, Mack, Blumenthal & Evans

[57] ABSTRACT

A barrier layer of amorphous silicon carbide is formed on aluminum drum, and a photoconductive layer formed of a mixture of para-μc-Si and a-Si is formed on the surface of the barrier layer. An a-Si surface layer is formed on the photoconductive layer. When the electrophotographic photoreceptor is exposed to a light ray, carriers are generated by the ray, which is visible or has a near-infrared wavelength, due to a smaller energy gap of the para-μc-Si in the layer.

15 Claims, 7 Drawing Figures

ELECTROPHOTOGRAPHIC PHOTORECEPTOR COMPRISING AMORPHOUS SILICON AND PARA MICROCRYSTALLINE SILICON

BACKGROUND OF THE INVENTION

This invention relates to an electrophotographic photoreceptor for electrophotography.

Until now, an electrophotographic photoreceptor has been prepared from inorganic materials such as CdS, ZnO, Se, Se-Te, or amorphous silicon, or organic materials such as poly-N-vinylcarbazole (PVCZ) or trinitrofluorenon (TNF). However, these conventional photoconductive materials have present various difficulties in manufacturing the subject product. Consequently, these materials have been selectively used in accordance with the intended object, with some lack in the desired properties of a photosensitive system.

For example, Se and CdS are harmful to the human body, demanding particular care in manufacturing, from the point of ensuring safety. Therefore, these materials are accompanied with the drawbacks that the manufacturing phase involves a complicated process, resulting in a high manufacturing cost and high recovery costs due to the required recovery of Se. Moreover, the Se and Se-Te series have as low a crystallization temperature as 65° C. Therefore, when copying is repeated, difficulties arise with respect to the photoconductive property, for example, in residual potential. Consequently, the Se and Se-Te series have a short effective life and reduced practicability.

Moreover, ZnO easily undergoes oxygen reduction, and is noticeably affected by exposure to the atmosphere, and has low reliability in application.

Further, organic photoconductive materials such as PVC and TNF are suspected to be carcinogens. These materials present difficulties from the point of view of safety to the human body, and, what is worse, are handicapped by low thermal stability, abrasion resistance and a short effective life, as is characteristic of organic materials.

On the other hand, amorphous silicon (hereinafter abbreviated as "a-Si") has recently attracted wide attention as a photoelectric converting material, and has been successfully applied for use in a solar cell, thin film transistor and image sensor. Description will now be made of the application of a-Si as the photoconductive material of an electrophotographic photosensitive member (Japanese patent disclosure Sho No. 59-12448). Not only a-Si is harmless and need not be recovered, but also it has a higher spectroscopic sensitivity in the region of visible rays than other materials. Further, it has a great resistance to abrasion and impact due to its significant surface hardness.

Research has been done on a-Si as a photosensitive member for electrophotography, based on the Carlson process. In this case, a photosensitive material having high dark resistance and photosensitivity is required. It is difficult, however, to provide a single layer photosensitive element which can satisfy both requirements. Hence, the conventional practice is to provide a barrier layer between the photoconductive layer and conductive support, and to deposit a surface charge-sustaining layer on the photoconductive layer, so that the resultant laminate structure may meet the abovementioned requirements.

Description may now be made of a-Si. Generally, this material is manufactured by the glow discharge decomposition process involving the application of silane series gas. In this case, hydrogen is carried into the a-Si layer. Electrical and optical properties noticeably vary with the content of hydrogen. Namely, the greater the quantity of hydrogen carried into the a-Si layer, the more enlarged the optical band gap, and consequently the resistance of the a-Si layer is raised. Since the a-Si layer is more reduced in sensitivity to the light rays having long wavelengths, it is difficult to practically utilize a laser beam printer equipped with, for example, a semiconductor laser device. When the a-Si layer contains much hydrogen, the greater part of the layer is sometimes occupied, for example, by a structure consisting of $(SiH_2)_n$ bonded with $SiH_2$. In this case, voids are noticeably generated, and silicon dangling bonds are increasingly produced. This event reduces the photoconductive property of the a-Si layer so much that the a-Si layer fails to serve a an electrophotographic photosensitive member. If, conversely, smaller quantities are taken into the a-Si layer, the optical band gap is reduced and decreases in resistance, but increases in the sensitivity to light rays having long wavelengths. The conventional a-Si layer, manufactured by the customary film-forming process, has a drawback. If its hydrogen content decreases, it tends to be coupled with silicon dangling bonds, resulting in a decrease in the content of hydrogen, which is desired to minimize said coupling. Therefore, there is the risk that generated carriers drop in transmission speed and have a reduced life, leading to the deterioration of the photoconductivity property of the a-Si layer, thereby rendering said a-Si layer unusable as an electrophotographic photosensitive member.

Description may now be made of the process of elevating the sensitivity of said a-Si layer to light ray having long wavelengths. This process comprises the steps of mixing a silane-series gas with germane $GeH_4$, applying glow discharge decomposition, and producing a layer having a narrow optical band gap. Generally, however, silane-series gas and $GeH_4$ have different optimum substrate temperatures, resulting in the occurrence of structural defects in the resultant layer and the failure to provide a satisfactory photoconductive property. The spent gas of $GeH_4$, if oxidized, will be converted into a noxious gas. Therefore, the treatment of the spent $GeH_4$ gas involves complicated steps. Consequently, the above-mentioned process involving the mixture of silane series gas and germane gas ($GeH_4$) lacks practicability.

SUMMARY OF THE INVENTION

It is accordingly the object of this invention to provide an electrophotographic photoreceptor which has an excellent charge-sustaining property, a low residual potential, a high sensitivity to a visible or a nearinfrared region, a better bondability to a substrate, and an excellent environmental resistance.

The electrophotographic photoreceptor of this invention comprises a substrate and a photoconductive layer containing amorphous silicon and paramicrocrystalline silicon. It is preferable to form a barrier layer between the substrate and the photoconductive layer. It is also preferred that a surface layer be formed on the photoconductive layer.

The para microcrystalline silicon (hereinafter referred to as para $\mu$C-Si) is distinguishable from microcrystalline silicon because the crystalline region cannot be directly observed, as in the case of amorphous silicon (hereinafter referred to as a-Si), by an X-ray diffraction, etc., and from the a-Si because the para μc-Si is smaller in optical energy gap and greater in drift mobility than the a-Si.

Because of this smaller optical energy gap and its greater drift mobility the para-μc-Si, if being applied to the photoconductive layer, reveals that its photoconductive layer is higher in a sensitivity to a ray of a longer wavelength and better in a photoconductive property. Hence if the para μc-Si and a-Si are used at least in the portion of the photoconductive layer of the photosensitive member, the electrophotographic photoreceptor of a better photoconductivity and of a higher sensitivity to a ray of a long wavelength can be obtained without losing the advantage gained from the a-Si.

The charge-sustaining property of the electrophotographic photoreceptor can be enhanced by forming the barrier layer between the photoconductive layer and the substrate.

The formation of the surface layer on the photoconductive layer results in less reflection and thus less light loss, and also in an enhanced charge-sustaining capability. Furthermore, the photoconductive layer is protected from damage.

DETAILED DESCRIPTION OF THE PREFERRED EMBODIMENTS

An electrophotographic photoreceptor according to a first embodiment of this invention will be explained below with reference to the accompanying drawings.

Figure 1:
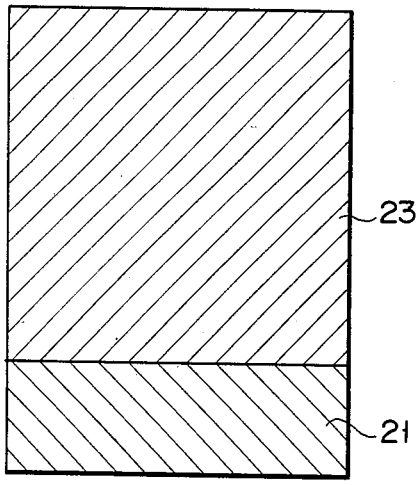
FIGS. 1 to 3 are cross-sectional views each showing a portion of an electrophotographic photoreceptor according to a first embodiment of this invention.
Figure 2:
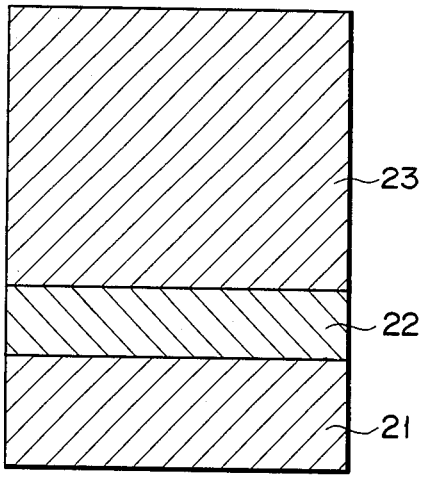
Figure 3:
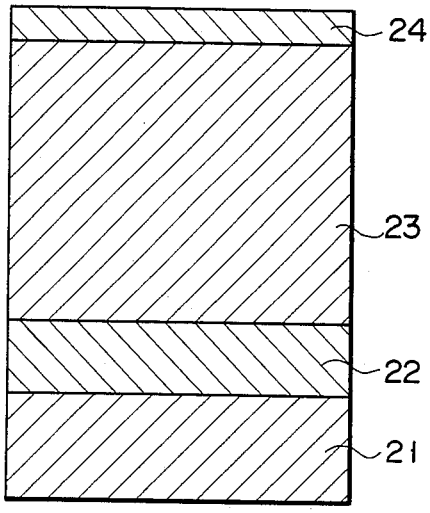

FIGS. 1 to 3 are cross-sectional views showing a portion of the electrophotographic photoreceptor according to one embodiment of this invention. In FIG. 1, photoconductive layer 23 is formed on electroconductive substrate 21. In FIG. 2, photoconductive layer 23 is formed over conductive substrate 21 with barrier layer 22 formed therebetween. In FIG. 3, surface layer 24 is formed on the surface of the structure of FIG. 2. Photoconductive layer 23 is formed of hydrogen-bearing para-μc-Si and a-Si, noting that the para-μc-Si is clearly distinguishable from the a-Si and μc-Si microcrystalline silicon with respect to the following physical features.

That is, for the para μc-Si, the crystal area cannot be directly observed with the use of an X-ray diffraction and electron microscope as in the case of the a-Si. In this respect the para μc-Si can be distinguished from the μc-Si which manifests an X-ray diffraction peak at $2\theta=28$ to 28.5°. Furthermore, the para μc-Si can be evidently distinguished from the a-Si because the drift mobility is greater than that of the a-Si. This phenomenon is due to the formation of "percolation" in the para μc-Si. The para μc-Si, if being heat-treated at about 500° to 600° C., is "microcrystallized" to allow an observation of it by the X-ray diffraction, while, on the other hand, any microcrystallization process never occurs in the a-Si. This is because the para μc-Si provides a nucleus on which the microcrystal is grown.

The para μc-Si as used in the embodiment of this invention has the features of being smaller in the optical energy gap (Eg) and greater in the drift mobility than the conventional a-Si. That is, in the conventional a-Si the aforementioned energy gap (Eg) varies within a range of 1.65 to 1.70 eV and the drift mobility of electrons, if evaluated by a time-of-flight method, is about $10^{-2}$ to $1^{-10}$cm$^2$/V·S. On the other hand, the energy gap (EG) of the para μc-Si as used in this invention is about 1.60 eV and the drift mobility is about $10^{-1}$ to 1 cm$^2$/V·S. Thus para μc-Si-bearing photoconductive layer 23 has a high sensitivity to a ray of a long wavelength, for example, up to a near-infrared region of around 790 nm which is an oscillation wavelength of, a semiconductor laser, and the photoconductive layer reveals a better photoconductive property.

The photoreceptor including the aforementioned photoconductive layer is suitable for a printer with the use of the semiconductor laser or for a high-speed type copying machine.

The para μc-Si and a-Si contains, preferably, 0.01 to 30 atomic percent of hydrogen and, more preferably, 0.05 to 20 atomic percent of hydrogen, resulting in a better balance between light and dark resistances and thus in an improved photoconductive property.

It is preferred that at least one kind selected from the group consisting of nitrogen, carbon and oxygen be doped into the para μc-Si. This assures a higher dark resistance of the para μc-Si layer and thus a higher photoconductive property. It is considered that these elements are precipitated in a grain boundary of the para μc-Si layer and serve as terminators of silicon dangling bonds whereby the density of states in the forbidden band is decreased to permit the dark resistance to be increased.

It is preferable to form barrier layer 22, as shown in FIGS. 2 and 3, between electroconductive substrate 21 and photoconductive layer 23. Barrier layer 22 serves to suppress a flow of charges between electroconductive substrate 21 and photoconductive layer 23 and thus to attain a higher charge-retaining capability at the surface of the electrophotographic photoreceptor and a consequent higher charge-sustaining capability in the electrophotographic photoreceptor. In a Carlson system, in order to positively charge the surface of the photoreceptor, barrier layer 22 is made a P-type whereby the injection of electrons from the substrate 21 into photosensitive layer 23 is prevented. In order to negatively charge the photosensitive layer surface, on the other hand, the barrier layer is made an n-type, thereby preventing the injection of holes from the substrate 21 into photoconductive layer 23. It is possible to form an electrically insulating film, as barrier layer 22, on the surface of substrate 21. The barrier layer may be formed with the use of either the para μc-Si or the a-Si. The barrier layer is preferably 0.01 to 10 μm.

In order to make the para μc-Si and a-Si of the layer a P-type it is preferable to dope Group III element of the Periodic Table, such as B, Al, Ga, In and Tl. In order to make the para μc-Si layer an n type, on the other hand, it is preferable to dope Group V element of the Periodic Table, such as N, P, As, Sb and Bi. The doping of the P-type or the n-type impurity in this way prevents the charges from being moved from the substrate 21. Even if the P- or the n-type impurity is doped not only into barrier layer 22 but also photoconductive layer 23 to make the para μc-Si or a-Si a P type or an n-type, it is possible to prevent charges from being moved from substrate 21 to photoconductive layer 23.

Barrier layer 22 can be formed by broadening the band gap in that portion of photoconductive layer 23 which is situated on the side of substrate 21. To this end, carbon, oxygen and nitrogen may be incorporated in the a-Si portion of photoconductive layer 23. The blocking function can further be enhanced by doping the Group III or the Group V element into the C, O and N-incorporated a-Si portion. Furthermore, barrier layer 22 of high charge-sustaining and charge-retaining properties can be obtained by forming the C, O and N-incorporated a-Si layer and Group III or V element-incorporated a-Si layer one above the other.

As shown in FIG. 3, it is preferable to form surface layer 24 on photoconductive layer 23. The para μc-Si and a-Si portions of photoconductive layer 23 are liable to produce a light reflection due to its relatively greater refractive index of 3 to 4. If such light reflection happens, then light is absorbed into photoconductive layer 23 to a less extent, resulting in a greater light loss. It is, therefore, preferable to form surface layer 24 so that reflection may be prevented. Furthermore, the formation of surface layer 24 protects photoconductive layer 23 from being damaged. An enhanced charge-sustaining property is also obtained due to the presence of surface layer 24 so that charges better appears on the surface. As a material for forming surface layer 24 use may be made of:

(1) an inorganic compound, such as $Si_3N_4$, $SiO_2$, SiC, $Al_2O_3$, BN, a-SIN:H, a-SiO:H, a-SiC:H, para μc-SiN, para μc-SiO, para μc-SiC, μc-SiN, μc-SiC and μc-SiO; and (2) an organic material, such as polyvinyl chloride and polyamide.

An apparatus for manufacturing the electrophotographic photoreceptor according to this embodiment will be explained below with reference to FIG. 7

Figure 7:
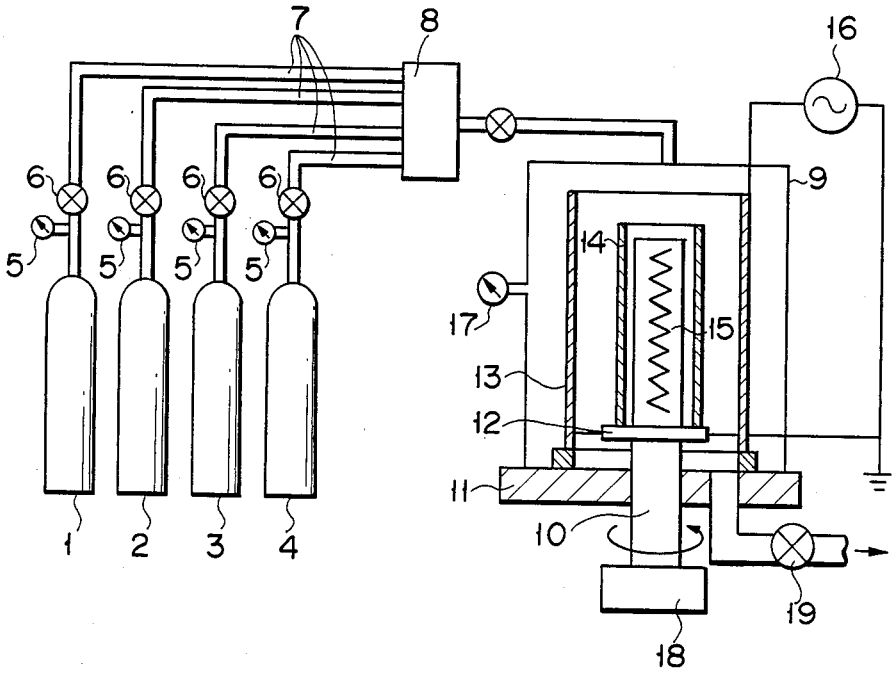
FIG. 7 is a model view showing a apparatus for manufacturing an electrophotographic photoreceptor of this invention.

In FIG. 7 a feed gas, such as $SiH_4$, $B_2H_5$, $H_2$, He, $CH_4$ or $N_2$, is contained in gas cylinders 1, 2, 3 and 4. The gases of gas cylinders 1, 2, 3 and 4 are supplied respectively through flow control valve 6 and pipe 7 into mixer 8. Pressure guage 5 is attached to the respective gas cylinder. The quantities of respective gases for supply to mixer 8, and their mixed ratio, can be controlled by the respective valves 6, while monitoring pressure gauges 5. These gases are mixed together at mixer 8 and then fed to reaction chamber 9. Rotation shaft 10 is vertically attached to bottom 11 of reaction chamber 9 so that it can be rotated. Disclike support table 12 is fixed to the top end of rotation shaft 10 with its surface set vertical to the rotation shaft. Cylindrical electrode 13 is disposed within reaction chamber 9 such that it is located on bottom 11 with the axis of the cylindrical electrode 13 aligned with the axis of rotation shaft 10. Furthermore, drum substrate 14 for the photoreceptor is placed on support table 12 with its axis aligned with the axis of rotation shaft 10. Heater 15 is located inside of drum substrate 14 to heat the drum substrate 14. High-frequency power supply 16 is connected between electrode 13 and drum substrate 14 to supply a high frequency current across electrode 13 and drum substrate 14. Rotation shaft 10 is rotated by motor 18. The pressure of reaction chamber 9 is monitored by pressure gauge 17 and reaction chamber 9 is connected through gate valve 19 to a suitable means, such as a vacuum pump.

Where the photoreceptor is to be manufactured on the aforementioned apparatus, drum substrate 14 is installed within reaction chamber 9 and then gate valve 19 is opened to allow the atmosphere within reaction chamber 9 to be exhausted to below a pressure of about 0.1 Torr. Then the gases of gas cylinders 1, 2, 3 and 4 are mixed at a predetermined mixed ratio and introduced into reaction chamber 9 in which case the quantities of the gases introduced into reactor 9 is so set that the pressure within reaction chamber 9 becomes 0.1 to 1 Torr. Then motor 18 is driven, causing drum substrate 14 to be rotated to permit drum substrate 14 to be heated by heater 15 to a predetermined temperature level. On the other hand, a high frequency current is supplied by high-frequency power supply 16 to allow glow discharge to occur therebetween. When this happens, para μc-Si or a-Si is deposited on drum substrate 14. Since $N_2O$, $NH_3$, $NO_2$, $N_2$, $CH_4$, $C_2H_4$, $O_2$, etc. are contained in the feed gas it is possible to incorporate these elements into the para μ-Si or the a-Si layer.

Where the para μc-Si and a-Si layer is formed according to this embodiment the film formation conditions thus involved are different from those involved when the conventional a-Si layer is formed. That is, the substrate is set to a temperature level higher than that involved when an a-Si layer is formed, and the high-frequency power is set to a level for the formation of the a-Si layer. Less fault-free layer can be formed when the feed silane ($SiH_4$) gas is diluted with, for example, a hydrogen gas or a helium gas. To state in more detail the temperature of the substrate is set to a level of over 200° C., preferably over 300° C. and a high-frequency power supply level is 0.05 watt, preferably 0.1 watt in power density.

Under such plasma conditions, hydrogen atoms at the surface of a silicon layer being formed collide with active hydrogen atoms and/or helium atoms and spring back, thus reducing the hydrogen quantity in the silicon layer. For this reason, the optical band gap of the photoconductive layer becomes smaller and the photoconductive layer is liable to absorb a ray of a longer wavelength and thus has a sensitivity to that ray. In other words, the para μc-Si or a-Si layer absorbs an energy greater than, and transmits an energy smaller than, the level of the optical energy gap $E_G$. The conventional a-Si layer whose energy gap $E_G$ is greater absorbs only a ray of a visible wavelength, while according to this invention, on the other hand, the corresponding layer can also absorb a near-infrared ray, for a smaller energy gap, which is longer in wavelength than the visible ray and smaller in energy.

Under the plasma conditions, the silicon atoms take more 4-coordinate bonds as an atom configuration and thus less dangling bonds. As a result, the silicon layer thus formed, differing from the conventional a-Si layer, reveals less defaults with a greater carrier mobility, in spite of a small quantity of hydrogen contained therein.

Where hydrogen is doped into the para μc and a-Si layer, glow discharge is utilized which causes when:

(1) A silane series feed gas, such as $SiH_4$ and $Si_2H_6$, and a carrier gas, such as hydrogen or helium are reacted within the reactor;

(2) A silicon halogenide, such as $SiF_4$ and $SiCl_4$, and a hydrogen or helium gas are reacted within the reactor; and (3) The silane series gas and silicon halogenide are reacted within the reactor.

In this connection it is to be noted that the para μc-Si and a-Si layer can be formed by not only the glow discharge method but also a physical method, such as sputtering.

Photoconductive layer 23 thus formed is preferably 1 to 80 μm in thickness from the standpoint of the photoconductive property and more preferably 5 to 50 μm in thickness.

As evident from the above, the electrophotographic photoreceptor of this invention can be manufactured on the aforementioned apparatus of a closed-system type, as in the case of the conventional counterpart with the use of an a-Si layer, thus providing no environmental hazard to the human beings. The photoreceptor of this invention, being excellent in heat-, moisture- and friction resistance, can be repetitively used, over a longer period of time, without being deteriorated. Since there is no need to use any gas, such as $GeH_4$, which is sensitized to a ray of a longer wavelength, it is not necessary to provide any spent gas treating equipment, thus assuring a very high yield.

An electrophotographic photoreceptor according to a second embodiment of this invention will now be explained below with reference to FIGS. 4 to 6.

Figure 4:
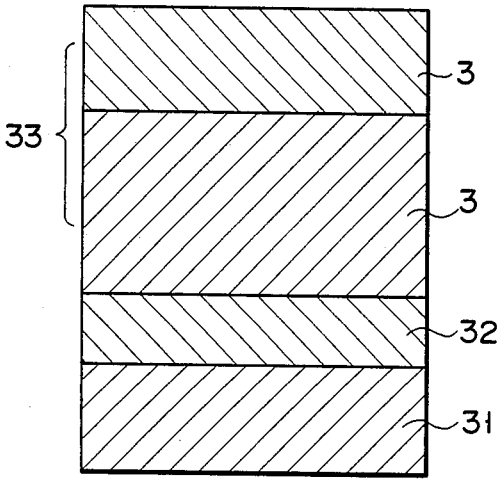
FIGS. 4 to 6 are cross-sectional views each showing a portion of an electrophotographic photoreceptor according to a second embodiment of this invention.
Figure 5:
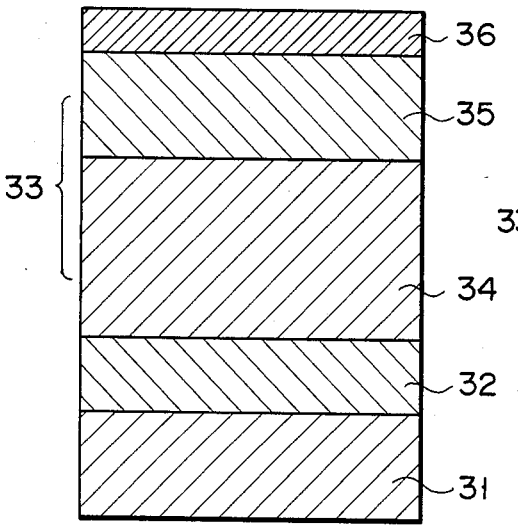
Figure 6:
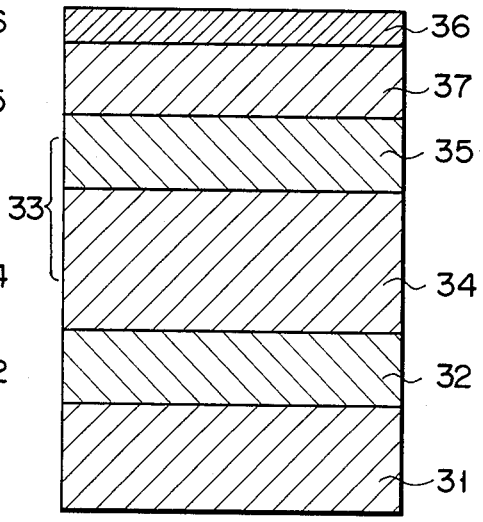

FIGS. 4 to 6 are cross-sectional views showing a portion of the electrophotographic photosensitive member. In the photoreceptor shown in FIG. 4, barrier 32 is formed on electroconductive substrate 31 of aluminum, and photoconductive layer 33 is formed on barrier layer 32. Photoconductive layer 33 is functionally separated into two layers: charge moving layer 34 and charge generating layer 35. Charge moving layer 34 is formed on barrier 32 and charge generating layer 35 is formed on charge moving layer 34. In the photoreceptor shown in FIG. 5, surface layer 36 is formed on charge generating layer 35, while in the photoreceptor shown in FIG. 6 a-Si charge generating layer 37 is formed between charge generating layer 35 and surface layer 36. In these cases, the a-Si charge generating layer 37 is formed under the conventional conditions.

Charge generating layer 35 generates carriers upon being exposed to a light ray. The charge generating layer 35 is so formed that its portion or its whole is formed of a single para μc-Si layer or a para μc-Si and a-Si layer. The aforementioned energy gap $E_G$ of charge generating layer 35 is below 1.65 eV, a smaller level than that of a conventional layer formed of the a-Si layer only, thus revealing a high sensitivity to a ray of a wider wavelength range. As a result, as in the case of the first embodiment of this invention the photoreceptor can have a high sensitivity to a ray of light ranging from the visible wavelength to, for example, around 790 nm (a near-infrared region), an oscillation wavelength of, for example, a semiconductor laser. The photoreceptor of this invention is suitable for a printer with the use of a semiconductor laser. This charge generating layer 35 is 0.1 to 30 μm in thickness, preferably 3 to 10 μm in thickness. It is preferable to dope the Group III or V element of the Periodic Table into charge generating layer 35. The charge-sustaining and -retaining properties can be enhanced by incorporating at least one element selected from the group consisting of C, O and N into the aforementioned layer.

Charge moving layer 34 allows carriers which are generated in charge generating layer 35 to reach the substrate 31 side with a high efficiency. It is, therefore, necessary for the carriers to have a longer life time and a greater mobility and thus high transport. Charge moving layer 34 with hydrogen atoms incorporated therein is formed of one or both of para μc-Si and a-Si whose drift mobility is over $10^{-1}$ $cm^2/V \cdot S$. This material can compensate for dangling bonds with the presence of a smaller quantity of hydrogen. It is therefore possible to form a charge moving layer with less faults and better carrier transit property. The photoreceptor thus formed is suitable for a high-speed operation type printer or a copying machine. In order to enhance the dark resistance and thus the charge-sustaining property it is preferable to dope the Group III or the Group-V element of the Periodic Table into charge moving layer 34. At least one kind selected from the group consisting of C, N and O may be incorporated into the aforementioned layer in order to provide an enhanced chargesustaining property and to share both the functions of charge moving layer 34 and charge generating layer 35. The charge moving layer never exhibits its full function if it is too thin or too thick. Therefore, charge moving layer 34 is 3 to 80 μm thick, preferably 10 to 30 μm thick.

Even in the function-separating type photoreceptor having charge generating layer 35 and charge moving layer 34, the charge sustaining and charge retaining function can be enhanced because of the formation of barrier 32 between substrate 31 and charge moving layer 34. Whether or not the barrier layer is made a P-type or an n-type is determined according to the charge sustaining property. As in the case of the first embodiment the barrier layer may be formed of a-Si or para μc-Si.

The surface layer 36 is formed on charge generating layer 35 or 37 and formed of the same material as in the first embodiment and has the same function.

In the photoreceptor as shown in FIG. 6, charge generating layer 37 formed of the conventional a-Si is formed on charge generating layer 35, but in this case it is possible to enhance a sensitivity to a ray of a long wavelength and thus to obtain a better photoconductive property.

The electrophotographic photoreceptor according to this invention will be explained below in connection with Examples which follows

EXAMPLE 1

This Example corresponds to the electrophotographic photoreceptor of the first embodiment shown in FIG. 3. An aluminum drum 80 mm in diameter and 350 mm in length, i.e., an electroconductive substrate, was degreased with trichloroethylene, placed within an reaction chamber. Then the atmosphere of the reaction chamber was evacuated, by a diffusion pump not shown, to a vacuum level of about $10^{-3}$ Torr. As required, the drum substrate surface was treated with an acid and an alkali, followed by a sand blast treatment. Then the drum was heated and maintained at about 300° C. Thereafter an $SiH_4$ gas having a 500 SCCM flow rate, $B_2H_6$ gas having a flow rate $10^{-6}$ with respect to the $SiH_4$ gas and $CH_4$ gas having a 100 SCCM flow rate were mixed and supplied into the reaction chamber. Thereafter, the atmosphere of the reaction chamber was evacuated, by a mechanical booster pump and rotary pump, to a pressure level of 1 Torr. Then a plasma of $SiH_4$, $B_2H_6$ and $CH_4$ was created between the electrode and the aluminum drum, while applying a high frequency power with 13.56 MHz and 300 watts to the electrode, to form a layer on the aluminum drum over a predetermined period of time. Thereafter the supply of the mixed gas and application of the electric power were stopped. By so doping, barrier 22 was formed which was formed of a P type of amorphous silicon carbide. Thereafter, an $SiH_4$ gas having a 200 SCCM gas flow rate, $B_2H_6$ gas having a flow rate of $10^{-7}$ with respect to the $SiH_4$ gas and $H_2$ gas having 1 SLM flow rate were introduced into the reaction chamber. Under a reaction pressure of 1.2 Torrs and high frequency power of 1 KW, photoconductive layer 23 with a thickness of 30 μm was formed containing para μc-Si and a-Si. Then a-Si surface layer 24 was formed, by the same process, which incorporated C, O or N therein.

The electrophotographic photoreceptor thus formed was mounted on a semiconductor laser printer and an image was formed by a Carlson process. In this case it has been found that a sharp, high-resolution image is obtained even when the surface of the photoreceptor is exposed with an exposure amount of 25 erg/cm$^2$. The copying operation was repeated and an examination was made for the reproducibility and stability at the transfer process. The result was that the images transferred were proved excellent with a better resistance to a corona discharge, moisture, wear and so on.

EXAMPLE 2

This Example corresponds to the second embodiment of this invention as shown in FIG. 5. Barrier layer 32 was formed under the same conditions as set out in connection with Example 1. Charge moving layer 34 was formed under the conditions of a $B_2H_6$ flow rate of $10^{-7}$ with respect to the $SiH_4$ gas, zero flow rate of $CH_4$ gas and application power of 350 KW and was found to be an a-Si layer of 20 μm.

Then an $SiH_4$ gas having a 200 SCCM flow rate, $B_2H_5$ gas having a flow rate of $10^{-7}$ with respect to the $SiH_4$ gas and $H_2$ gas having a 1 SLM flow rate were introduced into the reaction chamber. In this way, a charge generating layer of para μc-Si 5 μm in thickness was formed under the conditions of a reaction pressure of 1.2 Torrs and application power of 1 KW. Then an a-Si surface layer incorporating C, O or N therein was formed by the same procedure.

The photoreceptor thus formed was attached to a semiconductor laser printer and an image was formed by the Carlson process. It has been found that a sharp, high-resolution image is obtained even when the surface of photoreceptor is exposed with an exposure amount of 25 erg·/cm$^2$. The reproducibility and stability of the transfer process were examined through the repetitive copying operations. Consequently it has been found that the image transferred is excellent with a better resistance to corona discharge, moisture, wear and so on.

EXAMPLE 3

This Example corresponds to the function-separating type electrophotographic photoreceptor as shown in FIG. 5, noting that a barrier layer was formed under the same conditions as in Example 1. Charge moving layer 34 was formed, under a reaction pressure of 1.2 Torrs and application power of 2 KW, by introducing an $SiH_4$ gas having 200 SCCM flow rate, $B_2H_5$ gas having a flow rate of $10^{-7}$ with respect to the $SiH_4$ gas, $CH_4$ gas having a zero flow rate and $H_2$ gas having 2 SLM gas flow rate into the reaction chamber. It has been found that charge moving layer 34 of para μc-Si thus formed was 20 μm in thickness.

Then 5 μm-thick charge generating layer 35 of a-Si was formed by increasing the amount of $SiH_4$ gas and lowering the application electric power. Surface layer 36 of a-Si with C, O or N incorporated therein was formed by the same method.

An image was formed through the Carlson process with the resultant electrophotographic photoreceptor attached to the semiconductor laser printer. It has been found that a sharp image of high resolution is obtained even under the condition that the surface of the photosensitive member is exposed with an exposure amount of 25 erg·/cm$^2$. The reproducibility and stability the transfer process were examined through the repetitive copying operation. It has been found that the image thus formed is excellent with a better resistance to corona discharge, moisture, were and so on.

What is claimed is:

1. An electrophotographic photoreceptor, comprising a substrate, and a photoconductive layer supported on said substrate, said photoconductive layer containing amorphous silicon and para microcrystalline silicon.

2. The electrophotographic photoreceptor according to claim 1, wherein said photoconductive layer contains at least one kind selected from the group consisting of Groups III and V elements of the Periodic Table.

3. The electrophotographic photoreceptor according to claim 1, wherein said photoconductive layer contains at least one element selected from the group consisting of carbon, oxygen and nitrogen.

4. The electrophotographic photoreceptor according to claim 1, further comprising a surface layer formed over said photoconductive layer.

5. An electrophotographic photoreceptor, comprising a substrate, a photoconductive layer located above said substrate, said photoconductove layer containing an amorphous silicon and para microcrystalline, and a barrier layer formed between said substrate and said photoconductive layer, for suppressing a flow of charges between said substrate and said photoconductive layer.

6. The electrophotographic photoreceptor according to claim 5, wherein said photoconductive layer contains at least one kind selected from the group consisting of Groups III and V elements of the Periodic Table.

7. The electrophotographic photoreceptor according to claim 5, wherein said photoreceptor contains at least one kind selected from the group consisting of carbon, oxygen and nitrogen.

8. The electrophotographic photoreceptor according to claim 5, wherein said barrier layer is formed of amorphous silicon or para microcrystalline silicon.

9. The electrophotographic photoreceptor according to claim 8, wherein said barrier layer contains a least one kind selected from Groups III and V elements of the Periodic Table.

10. The electrophotographic photoreceptor according to claim 8, wherein said barrier layer contains at least one kind selected from the group consisting of carbon, oxygen and nitrogen.

11. An electrophotographic photoreceptor, comprising a substrate, a photoconductive layer located above said substrate, said photoconductive layer containing amorphous silicon and para microcrystalline silicon, a barrier layer formed between said substrate and said photoconductive layer for suppressing a flow of charges between said substrate and said photoconductive layer, and a surface layer formed over said photoconductive layer.

12. The electrophotographic photoreceptor according to claim 11, wherein said photoconductive layer contains at least one kind selected from Groups III and V elements of the Periodic Table

13. The electrophotographic photoreceptor according to claim 11, wherein said barrier layer contains at least one kind selected from the groups consisting of carbon, oxygen and nitrogen.

14. The electrophotographic photoreceptor according to claim 11, wherein said barrier layer is formed of amorphous silicon or para microcrystalline silicon.

15. The electrophotographic photoreceptor according to claim 11, wherein said barrier layer contains one kind selected from Groups III and V elements of the Periodic Table.

* * * * *